US009186529B2

(12) United States Patent
Correia

(10) Patent No.: US 9,186,529 B2
(45) Date of Patent: Nov. 17, 2015

(54) MOBILE ROOF SAFETY DEVICE

(75) Inventor: Paulo Correia, St. Leonard (CA)

(73) Assignee: PNRC INTERNATIONAL INC., St. Leonard, Quebec ( * ) Notice: Subject to any disclaimer, the term of this patent is extended or adjusted under 35 U.S.C. 154(b) by 671 days.

(21) Appl. No.: 13/439,159

(22) Filed: Apr. 4, 2012

(65) Prior Publication Data

US 2013/0264442 A1 Oct. 10, 2013

(51) Int. Cl.

| | |
|---|---|
| ***A62B 1/18*** | (2006.01) |
| ***A62B 35/00*** | (2006.01) |
| ***E04G 21/32*** | (2006.01) |

(52) U.S. Cl.

CPC ..... *A62B 35/0068* (2013.01); *E04G 21/3276* (2013.01)

(58) Field of Classification Search

CPC ..... A62B 35/0068
USPC ..... 182/3; 280/9
See application file for complete search history.

(56) References Cited

U.S. PATENT DOCUMENTS

| | | | | |
|---|---|---|---|---|
| 2,502,309 | A * | 3/1950 | Byrd | 280/43.23 |
| 3,189,363 | A * | 6/1965 | Pierrat | 280/35 |
| 3,315,974 | A * | 4/1967 | Weaver, Jr. et al. | 280/43.2 |
| 4,063,745 | A * | 12/1977 | Olson | 280/43.23 |
| 4,249,713 | A | 2/1981 | Glynn et al. | |
| 4,607,724 | A | 8/1986 | Hillberg | |
| 4,942,943 | A | 7/1990 | Flaherty | |
| 5,006,031 | A * | 4/1991 | Fossing et al. | 414/458 |
| 5,011,106 | A | 4/1991 | Cody | |
| 5,197,257 | A | 3/1993 | Nietling | |
| 5,730,407 | A | 3/1998 | Ostrobrod | |
| 5,829,203 | A * | 11/1998 | Ealer, Sr. | 52/37 |
| 6,227,553 | B1 * | 5/2001 | Palmer | 280/47.18 |
| 7,032,710 | B2 | 4/2006 | Anderson et al. | |
| 7,063,497 | B2 * | 6/2006 | Mast et al. | 414/572 |
| 7,665,248 | B2 | 2/2010 | Blackford | |
| 8,025,125 | B2 | 9/2011 | Vetesnik et al. | |
| 8,100,228 | B2 | 1/2012 | Hamilton et al. | |
| 2005/0236790 | A1 * | 10/2005 | Carter | 280/79.11 |
| 2007/0289811 | A1 * | 12/2007 | Smith | 182/3 |
| 2009/0321184 | A1 * | 12/2009 | Hamilton | 182/3 |
| 2010/0224388 | A1 * | 9/2010 | Lubanski | 174/97 |

FOREIGN PATENT DOCUMENTS

| | | | |
|---|---|---|---|
| GB | 2222430 | A * | 3/1990 |

* cited by examiner

*Primary Examiner* — Alvin Chin-Shue
(74) *Attorney, Agent, or Firm* — Norton Rose Fulbright Canada

(57) ABSTRACT

A mobile roof safety device and method of use for arresting the fall of a roof worker off an elevated flat roof is described. The mobile device comprises a displaceable frame having a weighted base adapted to be positioned on a flat roof surface for restraining a load. At least one actuable surface gripping assembly having a pivoting arm to which a safety line is attached for the engagement of a gripping formation is secured to the weighted base. When a pulling force is applied on the pivot arm by a worker attached to the safety line secured to the pivot arm, the gripping formation is biased in the flat roof surface to arrest the fall of the worker.

20 Claims, 4 Drawing Sheets

MOBILE ROOF SAFETY DEVICE

TECHNICAL FIELD

The present invention relates to a mobile roof safety device for use on flat roofs and to which one or more safety lines may be attached to arrest the fall of roof workers and/or to restrict the displacement of the workers within a predetermined zone on the roof.

BACKGROUND ART

Various safety apparatuses are used and to which roof workers can be attached to arrest the fall of a worker off the roof. Many of these devices are used for pitch roofs and wherein the worker is fitted with a harness to which a safety line with an energy absorbing locking mechanism is secured and attached to the device. The safety apparatus is usually retained on the roof by fasteners secured into the roof at a predetermined location. When there is a need to work in different areas of a roof, some of these apparatus require to be disconnected from the roof and reconnected at a different location. These fasteners damage the roof and require repair to prevent leakage. Also, the displacement of these apparatuses is time-consuming and poses a danger in that during the relocation of the apparatus the workers are not protected by the safety lines as they are connected to the safety apparatus which is disconnected from the roof. It is also known to use mobile vehicles when working on flat roofs and to which the workers are attached. However, these vehicles are supported on wheels and when a sudden pulling force is applied to the vehicle by a worker falling off a roof, the vehicle can be displaced on the roof thereby providing extra length in the safety line connected to the worker which may cause serious injury or death to the worker. It is not a fail-proof device, although it resolves the problem of being displaceable and not having to puncture the roof for securement of the device. Working on roofs is a dangerous occupation.

SUMMARY OF INVENTION

It is a feature of the present invention to provide a mobile roof safety device for use on substantially flat roofs for the safety of workers and which is capable of securing at least one and preferably at least two or more worker safety lines may be attached and which substantially overcomes the above-mentioned disadvantages of the prior art.

Another feature of the present invention is to provide a method of arresting the fall of a roof worker of an elevated flat roof using the mobile roof safety device of the invention which substantially overcomes the above-mentioned disadvantages of the prior art.

Another feature of the present invention is to provide a mobile roof safety device which has a weighted base of sufficient weight for travel restraint of roof workers.

Another feature of the present invention is to provide a mobile roof safety device having a weighted base adapted to be lowered onto the surface of a roof and to which is secured one or more actuable surface gripping assemblies, each of which is adapted to receive a life line and wherein the gripping assembly is engaged in the roof surface upon the fall of a worker off the roof to arrest the worker's fall together with the weighted base.

According to the above features, from a broad aspect, the present invention provides a mobile roof safety device for use on substantially flat roofs for the safety of workers. The roof safety device comprises a displaceable frame having a weighted base adapted to be positioned on a flat roof surface for restraining a load. Retractable frame displacement means is secured to the frame for displacing the frame on the flat roof surface with the weighted base elevated therefrom. At least one actuable roof surface gripping means is secured in a lower portion of the frame above the weighted base. A safety line attachment means is secured to the roof surface gripping means. Restoring means is provided to maintain the actuable roof surface gripping means a disengaged position. The roof surface gripping means is disposed spaced above the roof surface when the weighted base is lowered onto the flat roof surface whereby when a pulling force is applied to the safety line attachment means by a line attached to a worker falling off the roof, the roof surface gripping means is biased in the flat roof surface adjacent the weighted base to arrest the worker secured to the safety line with the weight of the weighted base providing additional restraint against the pulling force on the safety line.

According to a further broad aspect of the present invention there is provided a method of arresting the fall of a roof worker falling off an elevated flat roof. The method comprises: i) positioning a mobile roof safety device having a displaceable frame with a weighted base on the roof; ii) displacing the mobile roof safety device to a safe position of use; iii) retracting frame displacement means to lower the weighted base on the roof; iv) attaching a safety line to an actuable roof surface gripping means secured to the weighted base, the safety line being secured to an attachment secured to the roof surface gripping means which is maintained at a disengaged position by spring restoring means; and v) engaging the roof surface gripping means into the roof surface upon a load applied to the safety line overcoming a restoring means of the roof surface gripping means.

BRIEF DESCRIPTION OF DRAWINGS

A preferred embodiment of the present invention will now be described with reference to the accompanying drawings in which.

DESCRIPTION OF PREFERRED EMBODIMENTS

Figure 10:
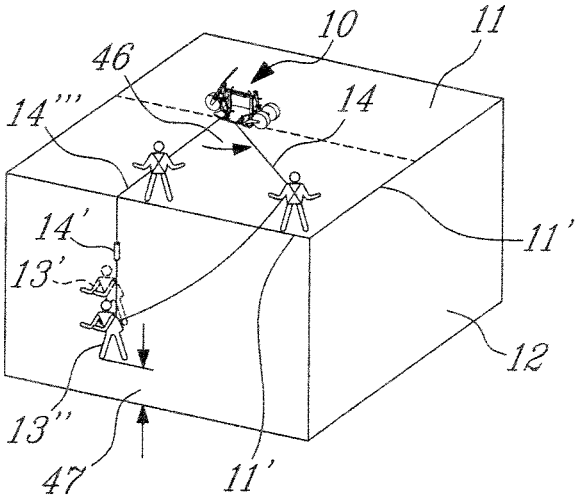
FIG. 10 is a schematic illustration demonstrating the use of the mobile roof safety device of the present invention.

Referring now to the drawings and more particularly to FIGS. 1 to 5, there is shown generally at 10 the mobile roof safety device of the present invention. As shown in FIG. 10, the mobile roof safety device 10 is for use on substantially flat elevated roofs 11 of building structures 12 whereby to prevent roof workers 13 secured to the device 10 of the present invention by safety lines 14 from falling off the roof. A worker, such as worker 13", which falls of the roof is arrested by the device 10 before reaching the ground surface.

Figure 2:
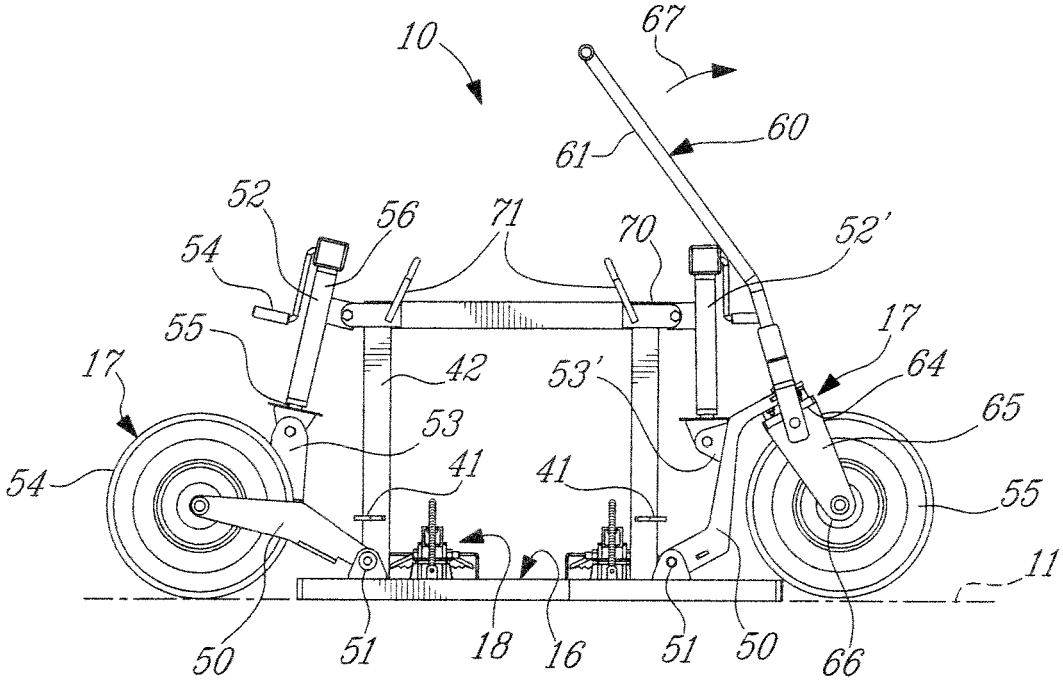
FIG. 2 is a side view of FIG. 1.
Figure 5:
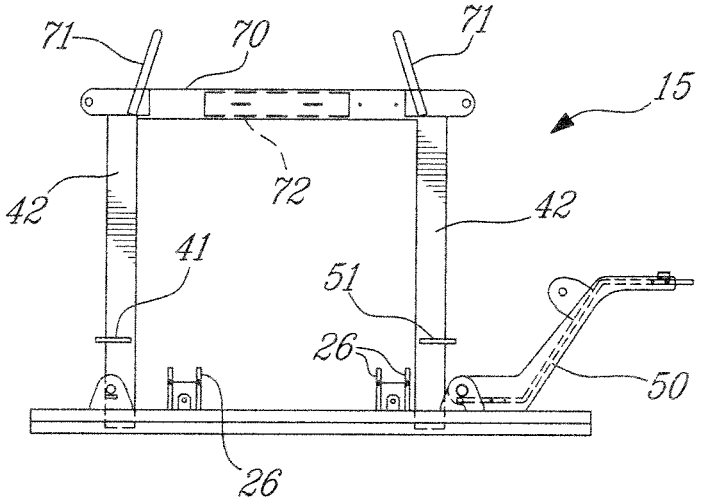
FIG. 5 is a side view of the frame of the mobile roof safety device of FIG. 1.

The mobile roof safety device 10 comprises a displaceable frame 15, as shown in FIG. 5, and which is provided with a weighted base 16 which is adapted to be lowered onto the flat roof surface 11, as shown in FIG. 10, with the bottom surface of the base 16 resting against the flat roof surface 11, as shown in FIG. 2. The weighted base 16 provides a dead load for travel restraint of one or more roof workers attached thereto. Retractable frame displacement means in the form of wheel assemblies 17 are secured to the displaceable frame 15 and adapted to displace the frame with the weighted base elevated by the wheel assemblies. The weighted base is also lowered onto the roof surface by these wheel assemblies, as will be described later.

Figure 4:
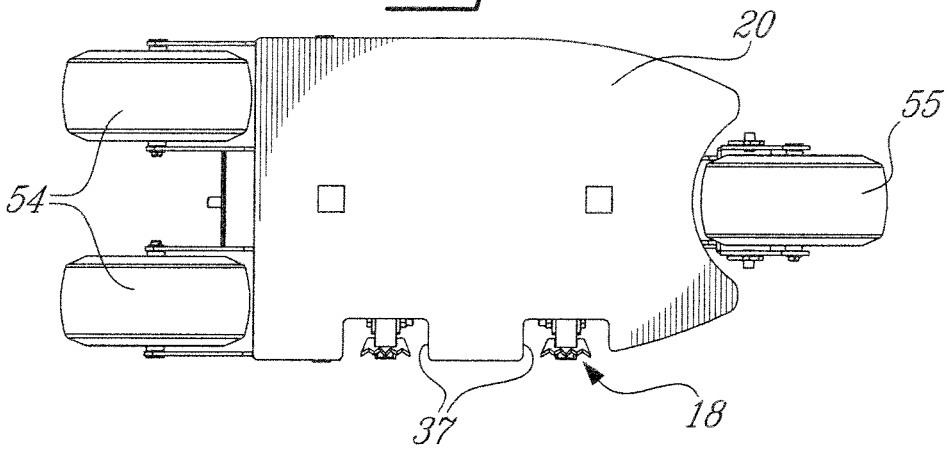
FIG. 4 is a bottom view of FIG. 1.

The mobile roof safety device 10 of the present invention is also provided with at least one actuable roof surface gripping means or assembly 18, herein two being shown and identical to one another and which are secured in a lower portion of the frame, herein to the top surface of the weighted base 16. The weighted base 16 is a solid metal plate provided with a flat bottom surface 20, as shown in FIG. 4. The solid metal plate has a predetermined weight in relation to the load to be connected thereto. In the particular embodiment hereinshown, the total weight of the mobile safety device weighs approximately 1000 pounds.

As also hereinshown, the surface gripping assemblies 18 are secured to a common side edge 21 of the weighted base 16 adjacent a work zone.

Figure 1:
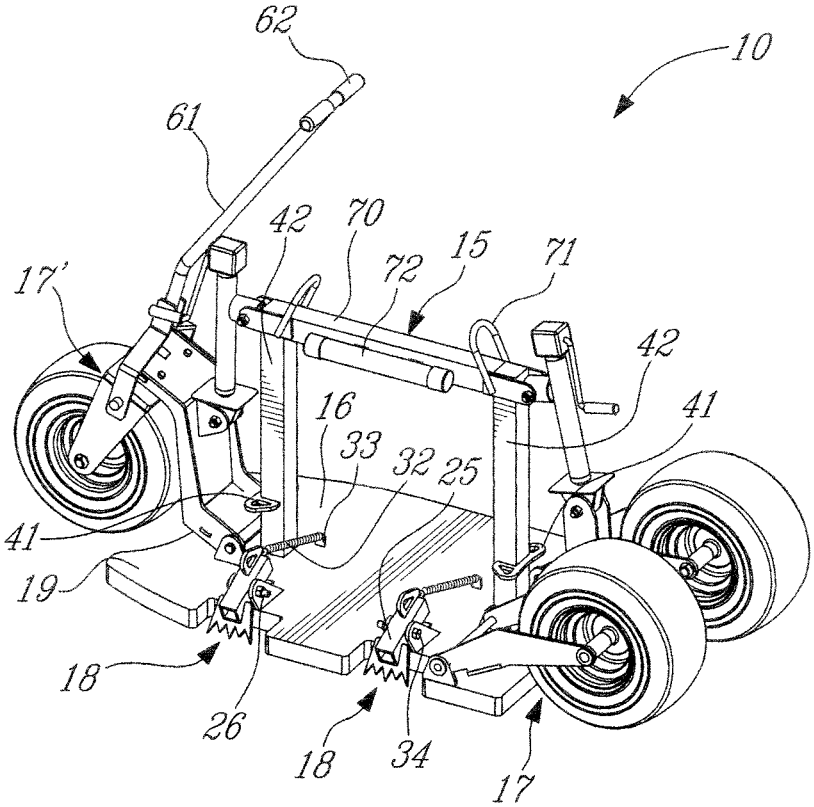
FIG. 1 is a perspective view of a mobile roof safety device constructed in accordance with the present invention.
Figure 6A:
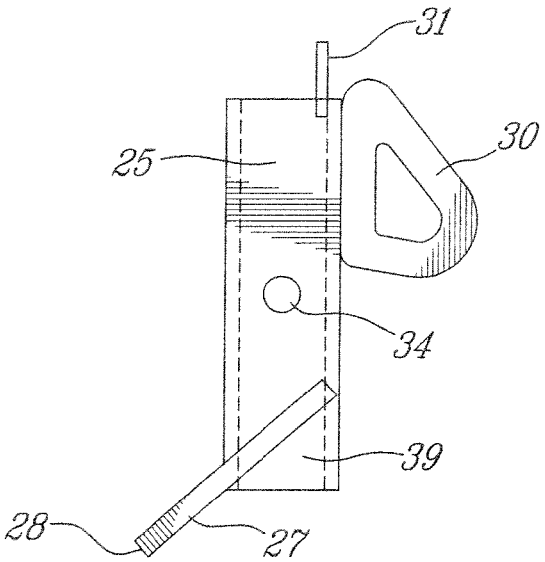
FIG. 6A is a side view of the pivoting arm of the actuable surface gripping assembly.
Figure 6B:
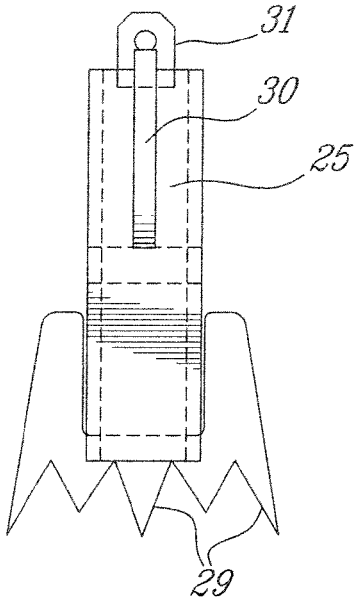
FIG. 6B is a further side view of the pivoting arm.

As more clearly shown in FIG. 1 and with further reference to FIGS. 6A and 6B, the actuable surface gripping assemblies 18 comprise a pivoting arm 25, herein a tubular arm of square cross-section constructed of steel and pivotally secured between a pair of spaced-apart parallel flanges 26, as better seen in FIG. 5, which are welded on the top surface 19 of the weighted base adjacent the edge 21. The pivoting arm 25 is provided with a gripping formation constituted by a gripping plate 27 having a lower claw edge 28 provided with a series of pointed teeth 29 whereby to engage into the roof surface 11. At the other end of the pivoting arm 25, there is provided a safety line attachment ring 30 which is welded to the pivoting arm 30. At the top end of the pivoting arm 25 there is also provided a spring attachment bracket 31 to which a helical spring 32 is secured, see FIG. 1. The other end of the helical spring 32 is attached to a further bracket 33 mounted on the top surface 19 of the weighted base 16. The helical spring constitutes a restoring means to maintain the pivoting arm at a disengaged position, as better shown in FIG. 7.

Figure 7:
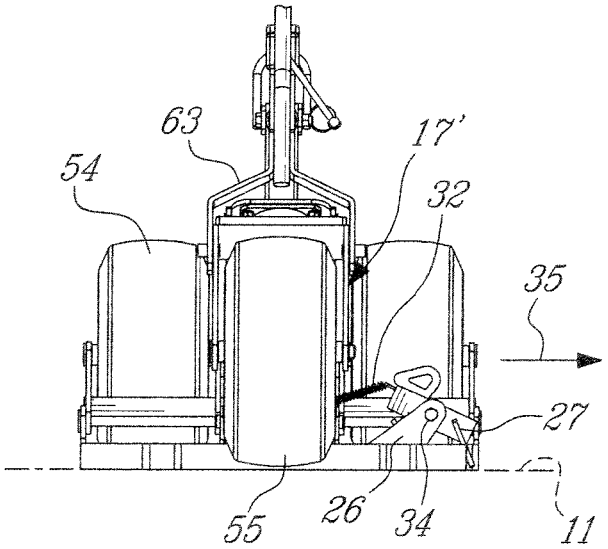
FIG. 7 is a fragmented end view of the lower portion of the mobile roof safety device illustrating the assembly of the actuable roof surface gripping means to the weighted base of the device.

As shown in FIG. 7, the gripping plate 27 has its pointed teeth 29 disposed spaced closely above the roof surface 11 whereby when a pulling force is applied to the pivot arm, in the direction of arrow 35 by the safety line 14 secured thereto and caused by a worker attached to the safety line and falling off the roof, the pivoting arm will pivot forward on its pivot connection 34 and cause the pointed teeth 29 of the claw edge to immediately engage into the roof surface 11. The arresting means of the gripping plate in combination with the weighted base will immediately provide a rigid connection and dead load to arrest the fall of the worker.

As shown in FIGS. 1 to 4, there are two surface gripping assemblies 18 secured adjacent the common edge 21 and these are spaced-apart from one another. The side edge 21 of the weighted base 16 is provided with recesses 37 to accommodate each of the surface gripping assemblies 18. Accordingly, the claw edge of the gripping plate 27 is engaged into the roof surface substantially in line with the common edge 21 of the weighted base. Therefore, the combined arresting force provided by the surface gripping assembly and the weighted base disposed onto the roof to provide a low center of gravity connection to prevent toppling of the mobile safety device 10 by the pulling force which is substantially in a plane close to the roof surface. This restraining force is calculated to exceed a total load which may be connected onto the mobile safety device by two workers simultaneously falling off the roof.

Figure 8:
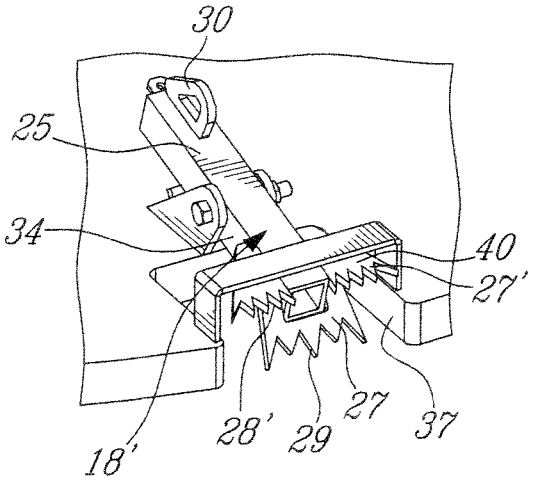
FIG. 8 is a perspective view showing a modification of the actuable roof surface gripping assembly.

With reference now to FIG. 8, there is shown a modification of the actuable roof gripping assembly, herein assembly 18'. The modification is constituted in that a second gripping plate 27' is secured to the lower end portion 39 of the pivoting arm 25 and disposed above the angulated gripping plate 27. This second gripping plate 27' extends substantially co-extensively with the pivoting arm 25 and provides further arresting means to meet different regulatory specifications. In order to engage the second gripping plate 27' into the roof surface, the load would have to cause the first gripping plate 27 to engage into the roof and then cause the pivoting arm 25 to continue pivoting on its pivot connection 34 and lift the weighted base 16 which would apply a load onto the pointed teeth 29 of the claw edge of the lower gripping plate 27 to further penetrate into the roof surface.

As shown in FIG. 8, a bridge arm 40 is secured over the second gripping plate 27' above the recess 37 to protect a safety line secured to the attachment ring 30 from contacting the claw edge 28' of the second gripping plate 27' and be damaged or severed. It is pointed out that the safety lines 14 as illustrated in FIG. 10 for use with roof workers having to work on edges of roofs are usually provided with an energy absorbing mechanism 14', well known in the art, whereby to absorb the load on the safety line caused by a worker falling off a roof and to lock on to the life line.

As shown in FIGS. 1, 2 and 5, there is further provided safety line connectors 41 secured to a pair of vertical posts 42 of the frame and secured to the top surface 19 of the weighted base and above the actuable roof gripping assemblies 18. These safety line connectors 41 are provided for the connection of safety lines of predetermined lengths to restrict the displacement of a worker in a restrained work zone delineated adjacent the mobile roof safety device 10 and spaced from the peripheral edges of a flat roof. This provides security to workers that are not permitted to work close to the peripheral edges of an elevated roof.

Figure 3:
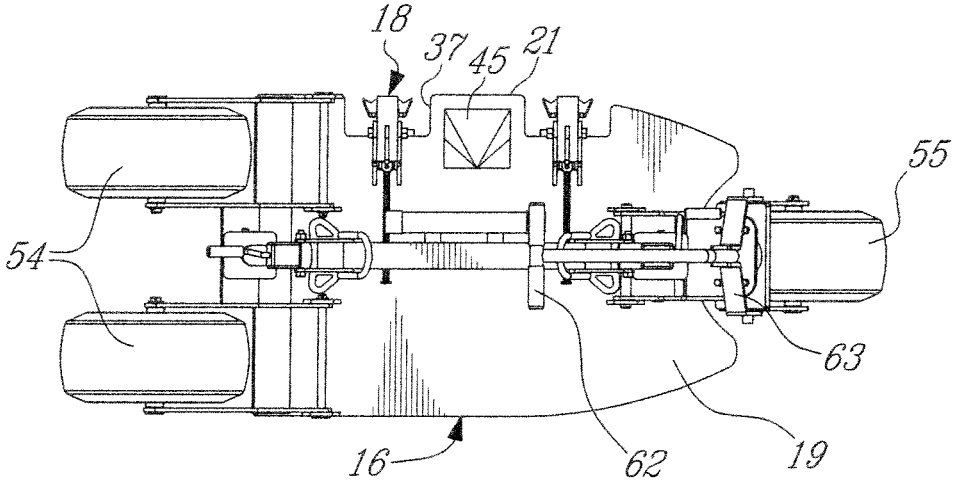
FIG. 3 is a top view of FIG. 1.
Figure 11:
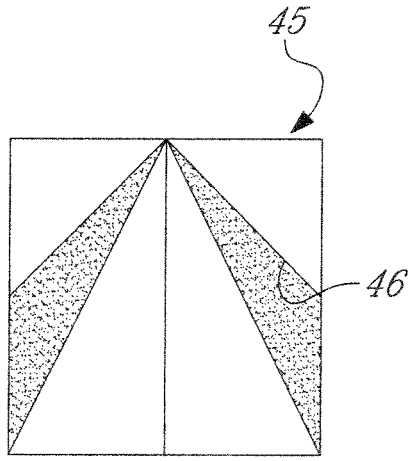
FIG. 11 is a plan view of an angle indicator decal which is affixed to the top surface of the weighted base and in relationship with one or more actuable roof surface gripping assembly.

As shown in FIGS. 3, 10 and 11, an angle indicator decal 45 is affixed to the top surface 19 of the weighted base 16 between the actuable roof gripping assemblies 18 and adjacent the common edge 21 to indicate the angle of displacement of roof workers attached to the actuable roof gripping assemblies 18. As shown in FIG. 7, the worker 11' is attached to a safety line 14 which lies at an angle 46 of substantially 45° to the transverse axis of the edge 21 of the base 16. This angle is indicated by the decal 45 and if the worker 11' was to fall off the roof at that point, the safety line would slide on the ledge of the roof to its maximal length as the fall of the worker's weight would pull the safety line 40 at an angle which is transverse to the weighted base 16, as indicated by the position of the line 14''', thus positioning the worker at an arrested position 13". Therefore, the positioning of the mobile roof safety device 10 must be calculated in relation to the building height whereby a worker falling off the building at a maximum working angle would clear the ground by a minimum of 4 feet, in accordance with the safety protocol, and this distance being indicated by reference numeral 47.

As previously described, the wheel assemblies 17 constitute a retractable frame displacement means. These wheel assemblies 17 are better illustrated in FIGS. 1 and 2 and as shown therein, there are two wheel assemblies 17 in a rear portion of the frame 15 a single central wheel assembly 17' in a front portion of the frame 15. Each of these wheel assemblies comprise a pair of pivotal support arms 50 pivotally connected to the frame 15 at a lower end through a pivot connection 51, and having an opposed upper end rotationally supporting a wheel. These support arms are pivotally displaced by a hand operable jack 52, one jack being pivotally connected to a common bracket 53 secure to the pivotal support arms 50 of the pair of rear wheels 54 between the upper and lower ends thereof, and another jack 52' being pivotally connected to a bracket 53' secured to the pivotal support arms 50 of the front wheel 55 between the upper an dlower ends thereof. These jacks are pivotally connected to the frame 15 above and spaced apart from the top surface 19 of the base 16 through pivotal connection with a respective one of the vertical posts 42. The jacks are provided with crank handles 54 whereby to cause a telescopic shaft secured in a cylinder 56 to be extended from or withdrawn into the cylinder whereby the wheels can be lifted above the flat roof surface 11 to position the weighted base thereon or lowered to lift the weighted base 16 off the work surface whereby to displace the mobile roof safety device 10.

Figure 9A:
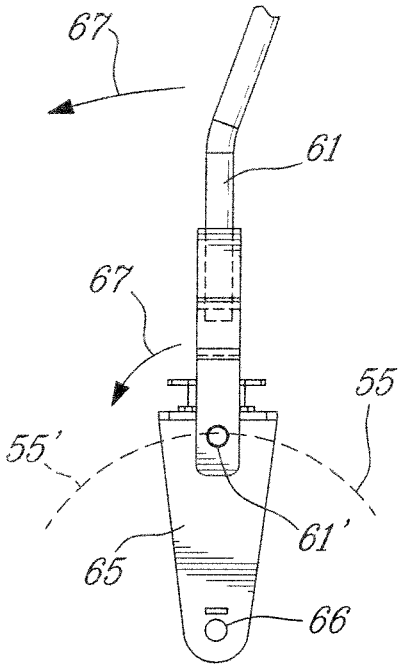
FIG. 9A is a side view of the pivotal displacement arm with its fork end secured to the support arms of the front wheel.
Figure 9B:
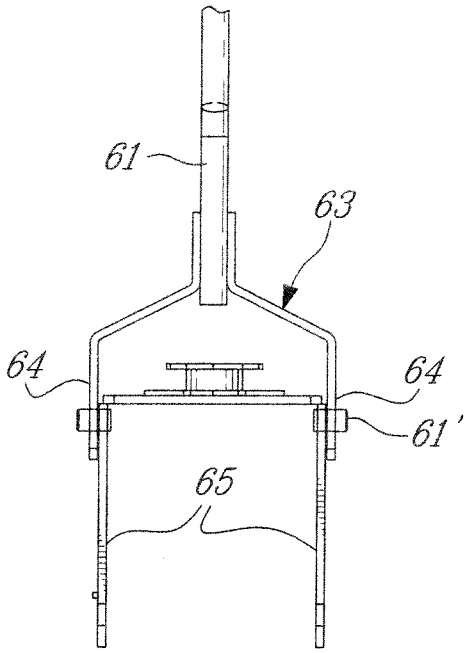
FIG. 9B is a front view of FIG. 9A.

With further reference now to FIGS. 9A and 9B, there is shown the construction of a pivotal displacement tow arm 60 which comprises a rod 61 having handle grips 62 at a free end thereof. The tow rod 61 has a fork formation 63 formed at a lower end thereof and defined by a pair of opposed parallel branch arms 64 to be pivotally at a top end of the wheel support bracket 65 on pivot 61'. The wheel 55 is secured at a lower end of the bracket 65 by its axle 66. Accordingly, the pivotal displacement arm 60 can be hinged forwardly in the direction of arrow 67 whereby to pull the mobile roof safety device 10 onto the roof surface to position it at a desired location. The fork bracket 63 also acts as a brake for engaging the top surface 55' of the front wheel 55, as shown in FIG. 9A, when hinged forwardly downwards in the direction of arrow 67 whereby to prevent movement of the mobile roof safety device when left on a roof with the weighted base 16 retracted. It is pointed out that for very large roofs such as high-rise buildings, it may be preferable to leave a mobile roof safety device 10 permanently on the roof and this feature therefore arrests the device at a desired stored location.

In order to elevate the mobile roof safety device 10 to a roof it is necessary to use a crane and for this purpose a lifting bar 70 is part of the frame and secured to the vertical posts 42 and provided with attachment steel loops or rings 71 to engage the device to a crane hoist cable. As also shown in FIG. 1, the mobile safety device is provided with a document storing tube 72 whereby to provide a manual of operation readily accessible to workers to instruct the worker on the use of the device and its safety features.

The mobile roof safety device 10 provides for a method of arresting the fall of a roof worker off an elevated flat roof and this method essentially consists in positioning the mobile roof safety device 10 with the wheels retracted. The wheels 54 and 55 are retracted so that one or more roof workers can attach their safety line to one of the actuable surface gripping assemblies 18 if he is to work close to the peripheral edge 11' of the roof or to the safety line connectors 41 if he is to work in a zone spaced from the peripheral edge 11' of a roof. It is pointed out that there may be several workers on the roof working in different zones. some close to the edge and some spaced form the edge of the roof and therefore they each connect to appropriate ones of either the actuable roof gripping assemblies 18 or the safety line connectors 41. If a roof worker was to fall of the edge of the roof, it would automatically engage the gripping formation into the roof surface upon the load provided by the worker secured to the safety line and these gripping formations in combination with the load of the weighted base will provide a restraining load to arrest the fall of the worker.

It is within the ambit of the present invention to cover any obvious modifications of the preferred embodiment described herein, provided such modifications fall within the scope of the appended claims.

I claim:

1. A mobile roof safety device for use on substantially flat roofs for the safety of workers, said roof safety device comprising:

a displaceable frame having a weighted base adapted to be positioned on a flat roof surface, said weighted base having opposed top and bottom surfaces, retractable wheel assemblies secured to said frame for displacing said frame on said flat roof surface with said bottom surface of said weighted base elevated therefrom, wherein said wheel assemblies each comprise:

pivotal wheel support arms pivotally engaged to the frame and supporting one or more wheels, and a jack pivotally engaged to the pivotal wheel support arms and pivotally engaged to the frame above and spaced apart from said top surface of said weighted base, said jack displacing said pivotal wheel support arms between a first position where said or more wheels protrude below said bottom surface of said weighted base to engage said flat roof surface and a second position where said or more wheels are above a plane defined by said bottom surface of said weighted base, at least one actuable roof surface gripping assembly secured in a lower portion of said frame above said bottom surface of said weighted base, said actuable roof surface gripping assembly being biased in a disengaged position , said roof surface gripping assembly in the disengaged position being disposed spaced above said plane defined by said bottom surface of said weighted base, and a safety line secured to said roof surface gripping assembly, wherein when a pulling force is applied to said safety line by a worker secured thereto falling off said roof, said roof surface gripping assembly moves away from the disengaged position and to an engaged position where part of the gripping assembly protrudes below said plane defined by said bottom surface of said weighted base, wherein with said wheel assemblies in the second position, said gripping assembly in the engaged position engages said flat roof surface adjacent said weighted base to arrest said worker secured to said safety line with the weight of said weighted base providing additional restraint against said pulling force on said safety line, and wherein one of said wheel assemblies is a front wheel assembly having a pivotal displacement low arm pivotally secured at a fork end to said wheel support arms, on a pivot axis, said one or more wheels including a front wheels secured between said wheel support arms, said pivot axis spaced above a wheel axis of said front wheel, said fork end engaging a tire of said wheel when said pivotal displacement arm is positioned at a predetermined forward and downward angle to constitute a brake for said wheel.

2. A movable safety device as claimed in claim 1 wherein said weighted base is a solid metal plate having a flat bottom surface, said roof surface gripping assembly being secured to a top surface of said solid metal plate adjacent a side edge thereof, said solid metal plate having a predetermined weight creating a dead load.

3. A movable safety device as claimed in claim 2 further comprising an additional roof surface gripping assembly, the roof surface gripping assemblies being spaced-apart from one another, said side edge of said solid metal plate having recesses therein for accommodating each surface gripping assembly.

4. A movable safety device as claimed in claim 1 wherein said actuable roof surface gripping assembly comprises a pivoting arm secured to a pivot connection, a gripping formation at a lower end portion of said pivoting arm, said safety line being secured to said pivoting arm above said pivot connection.

5. A movable safety device as claimed in claim 4 wherein said pivoting arm is pivotally secured above a top wall of said weighted base adjacent a side edge thereof, said roof surface gripping assembly being biased in the disengaged position by a helical spring secured to a top end portion of said pivoting arm and to said top wall of said solid metal plate.

6. A movable safety device as claimed in claim 4 wherein said gripping formation includes a gripping plate having a claw edge formed of pointed teeth, said gripping plate being secured to said lower end portion of said pivoting arm and disposed at a downward angle towards said flat roof surface.

7. A movable safety device as claimed in claim 4 wherein said gripping formation includes a first gripping plate having a claw edge formed of pointed teeth, said first gripping plate being secured to said lower end portion of said pivoting arm and disposed at a downward angle, and a second gripping plate secured to said lower end portion of said pivoting arm above said first gripping plate and extending substantially co-extensively with said pivoting arm, said second gripping plate also having a claw edge.

8. A movable safety device as claimed in claim 7 wherein a bridge arm is secured over said second gripping plate and secured above a recess accommodating said gripping assembly to protect said safety line from said claw edge of said second gripping plate.

9. A movable safety device as claimed in claim 4 wherein said safety line comprises an energy absorbing locking mechanism which is actuated by a predetermined load, said safety line being attached to a metal attachment ring secured to said pivoting arm.

10. A movable safety device as claimed in claim 1 wherein there is further provided safety line connection means immovably secured to said displaceable frame for the connection of safety lines of predetermined lengths relative to a restrained work zone delineated adjacent said mobile roof safety device and spaced from peripheral edges of said flat roof surface.

11. A movable safety device as claimed in claim 1 wherein said jack is a hand operable jack having an extendible and retractable telescopic shaft secured at a bottom end to said wheel support arms, and a crank to displace said telescopic shaft.

12. A movable safety device as claimed in claim 2 wherein there is further provided an angle indicator secured to said solid metal plate adjacent said side edge and in relation to said actuable roof surface gripping assembly to indicate a safe working zone for said worker secured to said actuable surface gripping assembly by said safety line.

13. A mobile roof safety device for use on substantially flat roofs for the safety of workers, said roof safety device comprising:

a displaceable frame having a weighted base adapted to be positioned on a flat roof surface, said weighted base having a bottom surface, retractable wheel assemblies secured to said frame for displacing said frame on said flat roof surface with said bottom surface of said weighted base elevated therefrom, said wheel assemblies secured to said frame, said wheel assemblies each comprising pivotal wheel support arms for supporting one or more wheels, said pivotal wheel support arms being displaceable to position said one or more wheels at a retracted position to lower said weighted base on said flat roof surface with said wheels spaced thereabove, and to an engaged position where said wheels are displaced below said bottom surface of said weighted base, at least one actuable roof surface gripping assembly secured in a lower portion of said frame above said weighted base, said actuable roof surface gripping assembly being biased in a disengaged position, said roof surface gripping assembly in the disengaged position being disposed spaced above a plane defined by said bottom surface of said weighted base, and a safety line secured to said roof surface gripping assembly, wherein when a pulling force is applied to said safety line by a worker secured thereto falling off said roof, said roof surface gripping assembly moves away from the disengaged position and to an engaged position where part of the gripping assembly protrudes below said plane defined by said bottom surface of said weighted base, wherein with the retractable wheel assemblies retracted such that said bottom surface of said weighted base rests against said flat roof surface, said gripping assembly in the engaged position engages said flat roof surface adjacent said weighted base to arrest said worker secured to said safety line with the weight of said weighted base providing additional restraint against said pulling force on said safety line, wherein one of said wheel assemblies is a front wheel assembly having a pivotal displacement tow arm pivotally secured at a fork end to said wheel support arms on a pivot axis, said one or more wheels including a front wheels secured between said wheel support arms, said pivot axis spaced above a wheel axis of said front wheel, said fork end engaging a tire of said wheel when said pivotal displacement arm is positioned at a predetermined forward and downward angle to constitute a brake for said wheel.

14. A movable safety device as claimed in claim 13 wherein said weighted base is a solid metal plate having a flat bottom surface, said roof surface gripping assembly being secured to a top surface of said solid metal plate adjacent a side edge thereof, said solid metal plate having a predetermined weight creating a dead load.

15. A movable safety device as claimed in claim 14 wherein there is further provided an angle indicator secured to said solid metal plate adjacent said side edge and in relation to said actuable roof surface gripping assembly to indicate a safe working zone for said worker secured to said actuable surface gripping assembly by said safety line.

16. A movable safety device as claimed in claim 14 further comprising an additional roof surface gripping assembly, the roof surface gripping assemblies being spaced-apart from one another, said side edge of said solid metal plate having recesses therein for accommodating each surface gripping assembly.

17. A movable safety device as claimed in claim 13 wherein said actuable roof surface gripping assembly comprises a pivoting arm secured to a pivot connection, a gripping formation at a lower end portion of said pivoting arm, said safety line being secured to said pivoting arm above said pivot connection.

18. A movable safety device as claimed in claim 17 wherein said pivoting arm is pivotally secured above a top wall of said weighted base adjacent a side edge thereof, said roof surface gripping assembly being biased in the disengaged position by a spring secured to a top end portion of said pivoting arm and to said top wall of said solid metal plate.

19. A movable safety device as claimed in claim 17 wherein said gripping formation includes a first gripping plate having a claw edge formed of pointed teeth, said first gripping plate being secured to said lower end portion of said pivoting arm and disposed at a downward angle, and a second gripping plate secured to said lower end portion of said pivoting arm above said first gripping plate and extending substantially co-extensively with said pivoting arm, said second gripping plate also having a claw edge.

20. A movable safety device as claimed in claim 19 wherein a bridge arm is secured over said second gripping plate and secured above a recess accommodating said gripping assembly to protect said safety line from said claw edge of said second gripping plate.

* * * * *